United States Patent [19]

Bellerose

[11] Patent Number: 4,778,067

[45] Date of Patent: Oct. 18, 1988

[54] KNOCK-DOWN SUPPORT STRUCTURE FOR SHELVING UNITS AND METHOD OF ASSEMBLY

[75] Inventor: Arthur L. Bellerose, Aurora, Ill.

[73] Assignee: White Consolidated Industries, Inc., Ohio

[21] Appl. No.: 66,325

[22] Filed: Jun. 25, 1987

[51] Int. Cl.[4] ..... A47B 47/00

[52] U.S. Cl. ..... 211/187; 211/192

[58] Field of Search ..... 211/187, 192, 193, 186, 211/190, 191; 108/144, 111; 248/223.1

[56] References Cited

U.S. PATENT DOCUMENTS 3,592,345 7/1971 Featherman ..... 211/187 X 4,074,812 2/1978 Shubic et al. ..... 211/192

4,378,925 4/1983 Griffin ..... 211/187 X 4,382,518 5/1983 Bondoux ..... 211/192

*Primary Examiner*—Reinaldo P. Machado

*Assistant Examiner*—Sarah A. Lechok Eley

*Attorney, Agent, or Firm*—Alfred E. Miller

[57] ABSTRACT

A knock-down support structure for shelving units having upright hollow posts with internal perpendicular channels and connecting horizontal stringers with bent ends inserted in said channels. The bent ends have struck-out tabs that are held in keyhole slots in the posts. The structure has a locking means on the stringers for locking the respective stringer to the adjacent post.

9 Claims, 2 Drawing Sheets

KNOCK-DOWN SUPPORT STRUCTURE FOR SHELVING UNITS AND METHOD OF ASSEMBLY

The present invention relates to upright and stringer members for shelving units and the method of assemblying shelving units of the knock-down type so that they can be easily and rapidly assembled on the job site.

It is well known that the knock-down type of shelving or storage racks provide flexibility over the welded and pre-assembled units. The advantage of conserving warehouse or storage space is obvious from the use of a variety of components rather than having a number of different sized pre-assembled storage or rack units in stock that cannot be altered to suit the customers needs.

The present invention features a knock-down metal shelving assembly utilizing thin elongated stringer elements of various lengths depending upon the depth of the upright to be used of the particular application. The ends of the stringers are bent at right angles to the axis of the respective stringer and are provided with tab-like projections for engagement with a keyhole slot in the upright post of the assembly. The tab-like projections are similar to the projections shown and described in U.S. Pat. No. 4,423,978 to Tiegelmann, and assigned to the assignee of the present invention.

A further object of the present invention is to provide means on each of said stringers for locking the stringer to the post after the tab-like projections are inserted in the selected keyhole slots.

The means for locking each of the stringers to the upright posts are rotatable cam elements that produce an outward force which forces the flange of the stringer into binding engagement with the respective upright post.

It is another feature of the present invention to provide means for easily and simply mechanically locking the stringers to the respective posts, and conversely, for easy and rapid disassembly of the constructed shelving unit assembly thus contributing to considerable labor saving and at the same time providing a tight connection between the end post and the stringers to provide rigidity of the overall construction, consequently assuring that the assembled unit has the necessary requisites for use in stores, offices, warehouses, and the like.

In order that the present invention will be more clearly understood, it will now be disclosed in greater detail with reference to the accompanying drawings, in which:

BRIEF DESCRIPTION OF THE DRAWINGS

FIG. 5 is a perspective view of an alternate cam locking device;

DESCRIPTION OF THE PREFERRED EMBODIMENTS

Figure 1:
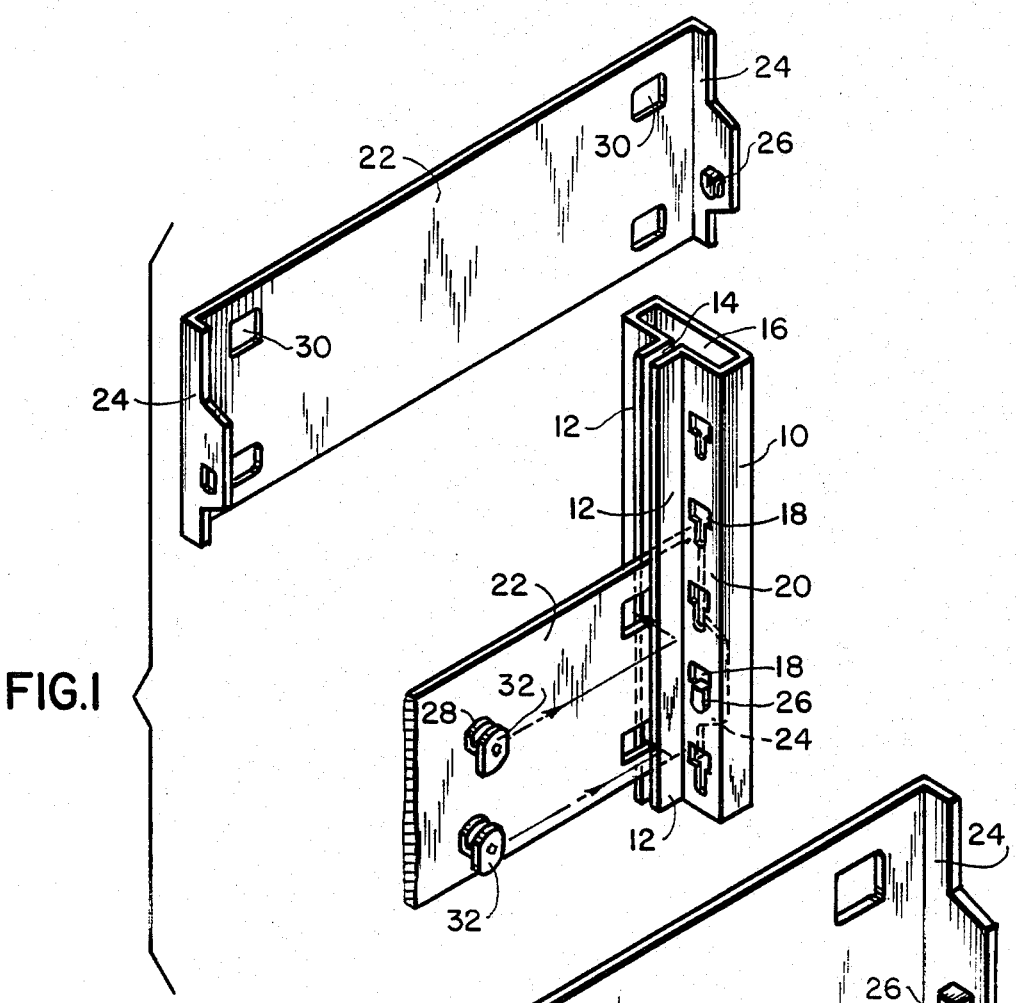
FIG. 1 is an exploded partial perspective view of the upright end post and a stringer inserted within said end post while another stringer is being prepared for the attachment to said end post, all in accordance with the teachings of my invention.
Figure 2:
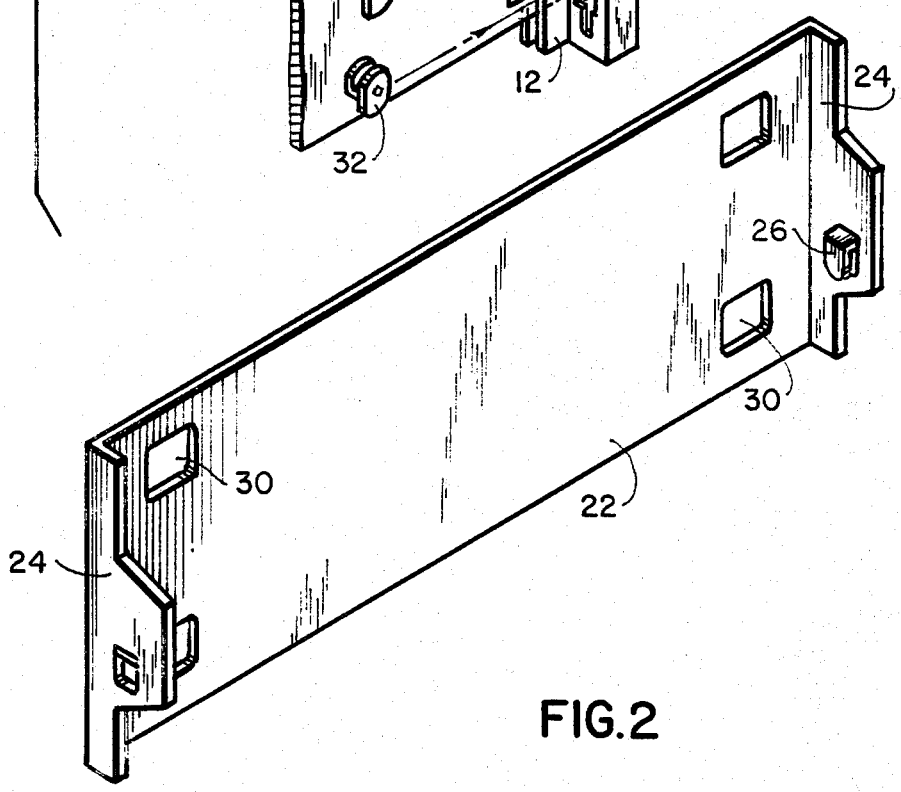
FIG. 2 is a perspective view of a stringer of the type used with the knock-down uprights of the present invention.

Referring particularly to FIGS. 1 and 2, a knock-down upright post or column 10 is shown having a T-shaped cross section wherein the legs 12 of the T are separated to form an elongated space 14 and the top of the T is provided with a space 16 substantially perpendicular to the space 14. The post 10 is also provided with a series of keyhole slots 18 located vertically at spaced positions in the wall 20 of the upright post 10.

In order to form a support structure for shelving, or the like, a multiplicity of the stringers 22 are employed which are utilized to interconnect to the posts 10 in order to provide a rigid support structure for shelving units that are flexible in that the configuration of the support structure can be easily altered by the builder, principally by changing the length of the stringers. Consequently, the stringers are mechanically fastened to the upright post and can be disassembled rapidly and easily, thereby resulting in the well-known flexibility which is associated with knock-down constructions.

The stringer 22, as seen in FIGS. 1 and 2, is an elongated thin plate having flanges 24 at each end bent in the same direction and extending substantially perpendicular to the longitudinal axis of the respective stringer, Furthermore, as seen in the drawings, each flange is provided with a struck-out, tab-like projection 26 of the type shown in U.S. Pat. No. 4,423,978, Tiegelmann. These tabs 24 are designed to be load-bearing with respect to the shelving units with the shelving units being supported by the upright frame assembly, and as seen in FIG. 1 the tabs are engaged in the respective keyhole slots 18 so that the stringer is rigidly held in place within the spaces 14 and 16, respectively, of the post 10. It is also evident that the post 10 may also take the form of an L-shaped member instead of the T-shaped construction shown in the drawings, without departing from the inventive concept.

In order to provide tight connections between the upright posts and the horizontally disposed stringers, and to assure that the overall support structure has a necessary rigidity, locking cams 28 are employed which are adapted to fit within selected rectangular openings 30 in the ends of each of the stringers 22 adjacent to the flanges 24.

Figure 3:
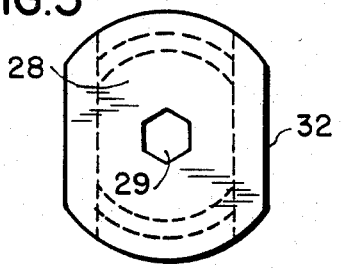
FIGS. 3 and 4 are front and side elevational views, respectively, which are enlarged, of a locking cam utilized in locking the stringers to the upright posts.
Figure 4:
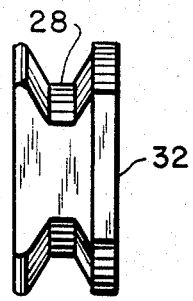

FIGS. 3 and 4 show one form of a locking cam that may advantageously be employed in connection with the present means for rigidly mechanically connecting the horizontal and vertical elements of the shelving support structure and at the same time providing for quick assembly and disassembly of the units. The locking cam 28 has a rectangular-shaped part 32 which is sized to fit snuggly through the opening 30 when the part 32 is fitted therein. Thereafter, the part 32 is rotated 90 degrees so that the part 32 tightly engages an outside surface of one of the legs 12 and holds the locking cam tightly in engagement with the stringer and the leg 12. The center of the locking cam 28 is provided with a hexagon-shaped hole 29 which is adapted to receive a hexagon shaped wrench (not shown) for rotating the cam 28 to its locked position described hereinabove.

Figure 5:
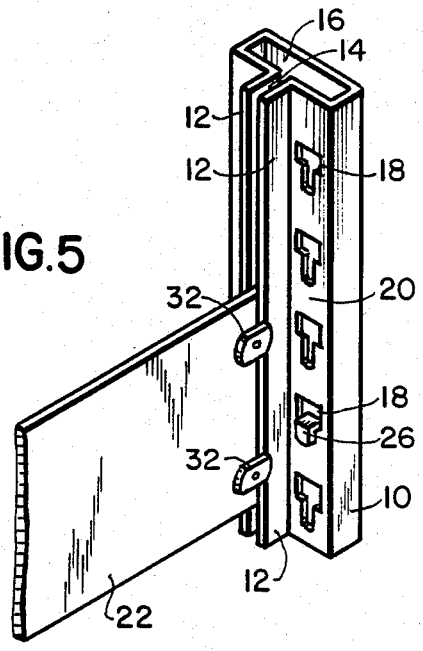
FIG. 5 is a partial perspective view showing the upright posts and stringers being secured and locked together, with the tab of the flange of the stringers being latched in the keyhole slot of the upright post while the locking cams are shown in their locked position.

Consequently, the locking cam itself is rotatable to a position shown in FIG. 5 of the drawings whereby the part 32 engages said outer surface of one of the legs 12 of the T-shaped post and thereby brings the bent flange 24 of the stringer 22 into binding engagement with the post 10. It should be noted that the locking cam can be made or fabricated either from formed sheet metal or from bar stock. In either case, the locking cam is designed to produce an outward force to bring the bent end flange 24 of the stringer 22 into binding engagement with the post to thereby create a mechanically fastened rigid structure which has the flexibility associated with a knock-down framework for shelving support.

Figure 6:
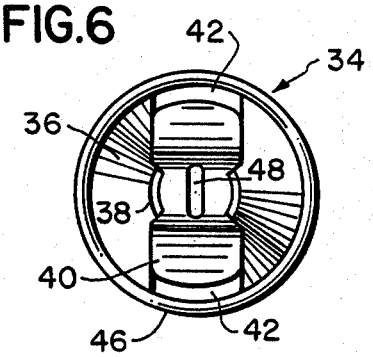
FIG. 6 is a front elevational view of the cam locking device on an enlarged scale.
Figure 7:
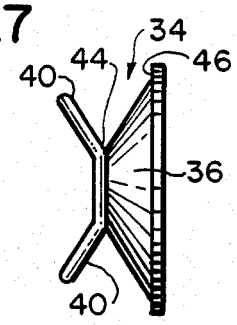
FIG. 7 is a side elevational of the device shown in FIG. 6.

Referring to FIGS. 6 and 7 a locking cam fabricated out of sheet metal is shown which is referred to generally by the reference numeral 34, and is provided with a circular back plate 36 which is shown to have a frustoconical shape. Struck out from the frustum 38 the locking cam has two oppositely directed tabs 40 which are located above the openings 42 in the locking cam. As seen in FIG. 7, a V-shaped groove 44 is formed between the peripheral edge 46 of the base 40 and the adjacent locking tab 40. Located between the locking tabs is a screw slot 48 for rotating the locking tab with a screwdriver to either its locked or unlocked position. In its latter position, the sheet metal cam is rotated to a position whereby a leg 12 is placed in the V-shaped groove 44 and either of the locking tabs 40 engages the outer surface of one the respective leg 12 of the T-shaped post 10, as seen in FIG. 5.

It should be apparent that a number of different cam constructions can be employed in the present invention to provide a locking arrangement for rapidly connecting and disconnecting stringers from upright posts or standards, so that shelving units may be either assembled or disassembled rapidly.

While the present invention has been disclosed and described with reference to several embodiments, it is apparent that variations and modifications may be made therein within the true spirit and scope of the invention as defined in the following claims:

What is claimed is:

1. A knock-down support structure for shelving units comprising an upright hollow post having a first channel and a second channel extending substantially perpendicular to said first channel and communication therewith, said post having a plurality of keyhole slots in spaced superposed relationship adjacent to said second channel, a connecting stringer having at least one extreme end being provided with a flange extending substantially perpendicular to the plane of said stringer and provided with a tab element on the surface of said flange adjacent to said keyhole slots, and a part of said stringer adjacent to said flange being inserted within said first channel while said tab element is in said second channel and latched in a selected keyhole slot.

2. A knock-down support structure for shelving units comprising an upright T-shaped, channelled hollow post wherein the bottom channel of said T is open at the bottom, said post having plurality of keyhole slots in the top channel of said T disposed in spaced, superposed relationship, a connecting stringer having at least one extreme end being provided with a flange extending substantially perpendicular to the plane of said stringer and provided with a tab element on the surface of said flange adjacent to said keyhole slots, a part of said stringer adjacent ot said flange being inserted through said bottom channel, said tab element being in said top channel and latched in a selected keyhole slot, and locking means on said part of the stringer for locking the respective stringer to the bottom channel of said T-shaped hollow post.

3. A knock-down support structure for shelving units comprising an upright inverted L-shaped channelled hollow post or standard wherein one leg of said post is open at one end, said post having a plurality of keyhole slots in the other leg of said post disposed in spaced, superposed in relationship, a connecting stringer adapted to be mounted perpendicular to said post and having at least one extreme end which is provided with a flange extending substantially perpendicular to the plane of said stringer and having a tab element on the surface of said flange adjacent to said keyhole slots, a part of said stringer adjacent to said flange being inserted through the open end of said leg, said tab element being in the other leg of said post and latched in a selected keyhole slot, and locking means on said stringer for locking the respective stringer to said one leg of said post.

4. A knock-down support structure as claimed in claim 2 or 3 wherein said locking means is a rotatable cam.

5. A knock-down support structure as claimed in claim 2 or 3 wherein said connecting stringer is provided with at least one opening in the part of said stringer adjacent to said flange and said locking means in the form of a rotatable cam member being mounted in said opening in one position thereof, and locking said stringer to said post in another position thereof.

6. A knock-down support structure as claimed in claim 5 wherein said rotatable cam is fabricated of sheet metal and said locking portion of said cam being a struck out tab.

7. A method of assemblying a support structure for shelving units from interchangeable parts comprising a plurality of spaced upright hollow posts having a pair of channels extending perpendicular to each other, inserting a plurality of said stringers having end parts within said channels, said end parts of said stringers being provided with tabs for insertion in keyhole slots in said posts, and providing a locking means on said stringers in the form of a rotatable cam lock for latching said stringers rigidly to said upright posts.

8. A method of erecting a support structure for shelving units as claimed in claim 7 further comprising inserting locking cams through openings in said stringers whereby when said locking cam is rotated approximately 90 degrees said cam latches the stringer to the adjacent post to provide a rigid support structure.

9. A method of assemblying a support structure for shelving units as claimed in claim 7 wherein said channels in each of said hollow posts are at right angles to each other and wherein the plane of said locking means is at right angles to the plane of said tabs whereby said locking means is operative for bringing at least a part of said stringer into binding engagement with a respective post

* * * * *

UNITED STATES PATENT AND TRADEMARK OFFICE

CERTIFICATE OF CORRECTION

PATENT NO. : 4,778,067

DATED : October 18, 1988

INVENTOR(S) : ARTHUR L. BELLEROSE

It is certified that error appears in the above-identified patent and that said Letters Patent is hereby corrected as shown below:

Column 3, line 46, change "communication" to --communicating--.

Column 4, line 3, change "ot" to --to--.

Signed and Sealed this

Twenty-eighth Day of February, 1989

*Attest:*

DONALD J. QUIGG

*Attesting Officer*

*Commissioner of Patents and Trademarks*